US006761280B2

(12) United States Patent
Zonker et al.

(10) Patent No.: US 6,761,280 B2
(45) Date of Patent: Jul. 13, 2004

(54) METAL END SHELL AND EASY OPENING CAN END FOR BEER AND BEVERAGE CANS

(75) Inventors: Harry R. Zonker, Pittsburgh, PA (US); Gary L. Myers, Sarver, PA (US); Robert E. Dick, Cheswick, PA (US); Darl G. Boysel, Delmont, PA (US); John S. Ward, Murrysville, PA (US)

(73) Assignee: Alcon Inc., Pittsburgh, PA (US)

( * ) Notice: Subject to any disclaimer, the term of this patent is extended or adjusted under 35 U.S.C. 154(b) by 0 days.

(21) Appl. No.: 10/033,257

(22) Filed: Dec. 27, 2001

(65) Prior Publication Data

US 2003/0121920 A1 Jul. 3, 2003

(51) Int. Cl.[7] ..... B65D 17/34

(52) U.S. Cl. ..... 220/269; 220/270; 220/619; 220/906

(58) Field of Search ..... 220/269, 270, 220/619, 906; B65D 17/34

(56) References Cited

U.S. PATENT DOCUMENTS

| | | | | |
|---|---|---|---|---|
| 3,843,014 A | | 10/1974 | Cospen et al. | |
| 4,039,102 A | | 8/1977 | Klett | |
| 4,093,102 A | | 6/1978 | Kraska | 220/67 |
| 4,109,599 A | | 8/1978 | Schultz | |
| 4,217,843 A | | 8/1980 | Kraska | |
| 4,448,332 A | | 5/1984 | Plummer, Jr. | |
| 4,606,472 A | | 8/1986 | Taube et al. | |
| 4,808,052 A | | 2/1989 | Bulso, Jr. et al. | |
| 4,809,861 A | | 3/1989 | Wilkinson et al. | |
| 4,813,223 A | | 3/1989 | Nipper et al. | 57/294 |
| 4,891,529 A | | 1/1990 | Braun et al. | 250/560 |
| 4,939,918 A | | 7/1990 | Schoch | 72/20 |
| 4,955,223 A | | 9/1990 | Stodd et al. | 72/336 |
| 4,991,735 A | | 2/1991 | Biondich | |
| 5,046,637 A | | 9/1991 | Kysh | |
| 5,149,238 A | | 9/1992 | McEldowney et al. | |
| 5,582,319 A | | 12/1996 | Heyes et al. | 220/454 |
| 5,685,189 A | | 11/1997 | Nguyen et al. | |
| 5,813,812 A | | 9/1998 | Moran et al. | 413/31 |
| 5,823,040 A | | 10/1998 | Stodd | |
| 5,857,734 A | | 1/1999 | Okamura et al. | |
| 5,911,551 A | | 6/1999 | Moran | 413/31 |
| 5,957,647 A | | 9/1999 | Hinton | 413/4 |
| 6,024,239 A | | 2/2000 | Turner et al. | 220/269 |
| 6,065,634 A | * | 5/2000 | Brifcani et al. | 220/619 |
| 6,089,072 A | | 7/2000 | Fields | |
| 6,102,243 A | | 8/2000 | Fields et al. | |
| 6,126,034 A | | 10/2000 | Borden et al. | 220/671 |
| 6,290,447 B1 | | 9/2001 | Siemonsen et al. | 413/56 |
| 6,330,954 B1 | | 12/2001 | Turner et al. | 220/269 |
| 6,460,723 B2 | * | 10/2002 | Nguyen et al. | 220/619 |
| 6,499,622 B1 | * | 12/2002 | Neiner | 220/619 |
| 6,561,004 B1 | * | 5/2003 | Neiner et al. | 72/715 |

FOREIGN PATENT DOCUMENTS

| | | | | |
|---|---|---|---|---|
| GB | 1 366 763 | | 9/1974 | |
| JP | 05112357 A | * | 5/1993 | B65D/17/32 |
| JP | 08258839 A | * | 10/1996 | B65D/17/34 |
| JP | 2544222 | | 5/1997 | |
| JP | 2000085768 A | * | 3/2000 | B65D/17/34 |
| JP | 2000109068 | | 4/2000 | |
| WO | WO98/34743 A1 | | 8/1998 | |
| WO | WO 98/37995 | | 9/1998 | |
| WO | 01/41948 | | 6/2001 | |

* cited by examiner

*Primary Examiner*—Stephen K. Cronin
*Assistant Examiner*—James Smalley
(74) *Attorney, Agent, or Firm*—David W. Brownlee

(57) ABSTRACT

A sheet metal end shell for conversion into easy opening beer and beverage ends with reduced metal usage while maintaining commercially acceptable buckle resistance. The end shell has an upper chuckwall portion that is disposed at an angle of about 20–35 degrees to vertical, a countersink bead having a width of about 0.020–0.040 inch, and further preferably having a countersink depth of less than about 0.250 inch and a panel depth less than about 0.070 inch.

34 Claims, 5 Drawing Sheets

METAL END SHELL AND EASY OPENING CAN END FOR BEER AND BEVERAGE CANS

FIELD OF THE INVENTION

The present invention relates to improved metal end shells for use in producing easy opening ends for beer and beverage cans. An end shell of this invention has an improved profile that facilitates metal savings while maintaining commercial requirements for buckle resistance of the manufactured easy opening ends as packed on pressurized cans. This invention facilitates use of aluminum sheet material having average longitudinal yield strengths of about 53.5 ksi in the manufacture of the end shells and easy opening ends and therefore facilitates the use of thinner gauge metal.

BACKGROUND OF THE INVENTION

The desirability of reducing metal usage in can ends for pressurized beer and beverage cans has been well recognized for at least thirty years. Many patents have been granted on various end shell and easy opening end designs and methods of manufacture for achieving such reduced metal usage.

Most commercial end shells for pressurized beer and beverage ends today are formed by a so-called free forming or semi-free forming technique in which the countersink bead in the end shell is formed by causing the metal to be rolled into the shape of the countersink bead as is illustrated and described in U.S. Pat. No. 4,109,599 in the name of Freddy R. Schultz. According to the teaching of that patent, a first supporting tool is moved against the exterior surface of the peripheral end curl and a second stationary supporting tool is applied against the interior surface of the central wall portion to cause the countersink or reinforcing channel to form in the end shell. The free forming technique of the Schultz patent has enabled the use of higher yield strength aluminum alloys (50 ksi and higher) and reductions in metal gauge while maintaining buckle resistance against relatively high pressures in containers. FIG. 1 hereof shows a typical commercial end shell formed by such a technique. As shown in that figure, the end shell has a central wall portion 10, an inner wall 80, an annular groove 78, a frustoconical portion 14 and a peripheral flange 16. In a preferred embodiment, the central wall portion is disposed at a height h of from 0.070–0.090 inch above the bottom of he annular groove 78.

U.S. Pat. No. 6,065,634 to Brifcani et al. discloses a can end and method for fixing it to a can body using less metal, while still permitting stacking. FIG. 2 hereof is representative of end shells made in accordance with the Brifcani et al patent. The can end has its chuckwall 24 inclined to vertical at an angle C° between 20° and 60°, and preferably between 40 degrees and 45 degrees, and has a concave bead (or countersink) 25 with a radius $r_3$ less than about 0.75 mm (0.0295 inches). The can end is preferably made from a laminate comprising an aluminum magnesium alloy sheet such as 5182 or an aluminum manganese alloy such as 3004 with a layer of polyester film on one side. Table 2 in the patent includes dimensions of end shells made in accordance with the patent as having a countersink height $h_2$ of 6.87 mm (0.270 inch) to 7.37 mm (0.290 inch), a panel height $h_3$ in a range of 2.39 mm (0.094 inch) to 2.80 mm (0.114 inch), and a lower chuckwall height $h_4$ in a range of 2.29 mm (0.09 inch) to 2.74 mm (0.11 inch).

WO 98/34743 (A1) in the name of Carnaudmetalbox PLC illustrates and describes an unseamed can end and a method of reforming it similar to that disclosed by U.S. Pat. No. 6,065,634 except that the chuckwall has two parts comprising a first (upper) part inclined to vertical at an angle between 1° and 39° and a second (lower) part inclined to vertical at an angle of between 30° and 60°. The first part of the chuckwall is deformed during a seaming operation to be substantially vertical as constrained between the seaming roll and the cylindrical sidewall of the chuck.

U.S. Pat. Nos. 4,217,843 and 4,448,332 to Kraska disclose a metal end shell and method and apparatus for forming it from sheet metal having reduced thickness. FIG. 3 hereof represents Kraska's end shell which has a countersink 20 having a radius $R_1$ less than three times the metal thickness, a depth H of at least 0.075 inch, and an outer wall 24 in the countersink having an angle B that is preferably less than five degrees to a vertical plane P. The end shell further has a second wall portion 34 defined by an angle C that is preferably at least six times greater than angle B. A peripheral curl 12 and central panel portion 14 border the countersink 20 and wall portion 24. The patent states that several million 209 diameter ends were made in accordance with the invention from 0.012 gauge 5182-H19 aluminum in which the finished ends have a radius R1 of approximately 0.030 inches, an angle B of approximately 4 degrees and an angle C of approximately 25 degrees.

Other end shell profiles and techniques for reducing metal usage while maintaining acceptable buckle resistance are disclosed in U.S. Pat. No. 6,102,243 (Fields et al.), U.S. Pat. No. 6,089,072 (Fields), U.S. Pat. No. 5,685,189 (Nguyen et al.), U.S. Pat. No. 5,046,637 (Kysh), U.S. Pat. No. 4,991,735 (Biondich), U.S. Pat. No. 4,809,861 (Wilkinson et al.), U.S. Pat. No. 4,606,472 (Taube et al.), U.S. Pat. No. 4,093,102 (Kraska), and U.S. Pat. No. 3,843,014 (Caspen et al.); and Japanese Utility Model No. 2,544,222, among others.

Despite the significant progress that has been made in reducing the gauge of metal used in end shells while maintaining buckle resistance, further enhancements are needed that will facilitate the uses of higher yield strength metal in such end shells and thereby facilitate greater metal savings.

SUMMARY OF THE INVENTION

This invention is particularly addressed to end shells that are to be converted into easy opening ends for beer and beverage cans, and to such converted ends suitable to be double seamed on aluminum can bodies. Most end shells and can ends in commercial use today are made of hard temper aluminum alloys, most of which alloys contain magnesium in a range of about 4.0 to 5.0 weight percent. For example, most easy opening ends for beer and beverage containers are currently made of 5182 aluminum alloy containing about 4.5–4.7 weight percent magnesium. Continual improvements in these aluminum alloys and their manufacture into sheet material are producing materials of higher longitudinal yield strength and ultimate strength. Such higher yield strength alloys provide opportunities for reducing metal usage through gauge reduction. One such alloy is 5019A aluminum alloy, as registered with the American Aluminum Association. That alloy contains a nominal weight percent of magnesium of 4.9, and has an average longitudinal yield strength of 53.5 ksi.

Can end diameters for beer and beverage cans have been getting smaller in order to reduce metal usage in the ends. Can end sizes are conventionally described in terms of inches and sixteenths of inches, such that a can end having a diameter of 2 6/16 inches, for example, is referred to as a 206 diameter can end. A 202 diameter can end has a diameter of 2 2/16 inches. Most beer and beverage can ends today are 204 and 202 diameters.

This invention is addressed to maintaining commercially required buckle resistance of can ends. Buckle resistance means the resistance of can ends to being permanently deformed by internal pressure in packed cans on which the ends are double seamed. Beer ends typically must be able to resist pressures of at least about 92 psig in the cans, and beverage ends typically must be able to resist pressures of at least about 90 psig.

A feature of end shells of this invention is that they have reduced age buckle losses, which are losses in buckle resistance following manufacture of the end shells and easy opening can ends. As used herein, age buckle losses means the loss in buckle resistance within a certain number of days, such as 30 or 90 days, after manufacture of the end shells and ends. Excessive age buckle losses are a known shortcoming of current end shells since the losses make it difficult for manufacturers to predict the eventual buckle resistance of their can ends.

This invention provides a metal end shell having an annular countersink bead around a central panel portion, a substantially vertical lower chuckwall portion in the countersink bead, an upper chuckwall portion extending upwardly and outwardly from the lower chuckwall portion at an angle of about 20–35° to vertical, and a curved peripheral flange for double seaming to a container wall. The countersink bead has an internal width of about 0.020–0.040 inch and the end shell has a countersink depth less than about 0.250 inch.

This invention provides a metal end shell profile that can be formed with a low draw ratio, thus permitting the use of higher yield strength metal.

Accordingly, it is an object of this invention to provide a metal end shell having commercially acceptable buckle resistance with reduced metal usage.

Another object of this invention is to provide an end shell that facilitates use of higher yield strength metal.

A further object of this invention is to provide a metal end shell that has reduced buckle losses during aging.

Another object of this invention is to facilitate the use of thinner gauge metal in end shells for pressurized containers.

A further object of this invention is to provide an end shell that is easier to form and which can be formed with a low draw ratio and with a shorter press stroke.

Another object of this invention is to provide an end shell that can be formed from a sheet metal disc having a reduced cut edge diameter.

A further object of this invention is to provide an end shell on which additional forming operations may be performed to enhance the performance characteristics.

The above and other objects and advantages of this invention will be more fully understood and appreciated with reference to the following description and the drawings attached hereto.

DESCRIPTION OF PREFERRED EMBODIMENTS OF THE INVENTION

Figure 1:
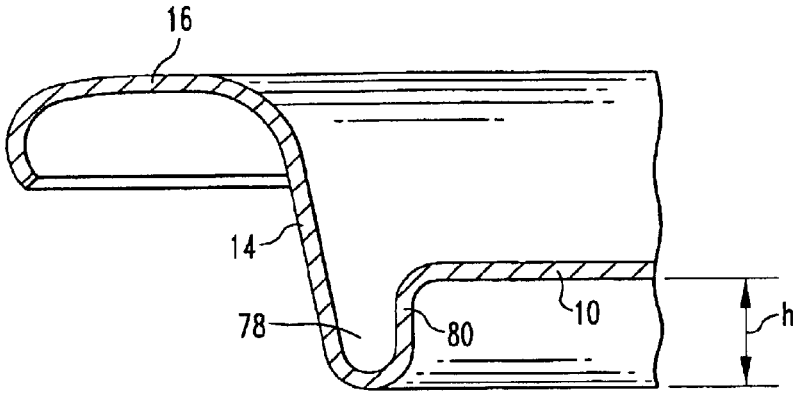
FIG.1 PRIOR ART
FIG. 1 (Prior Art) is a fragmentary cross-sectional view through a typical commercially produced metal end shell known in the can making industry.
Figure 2:
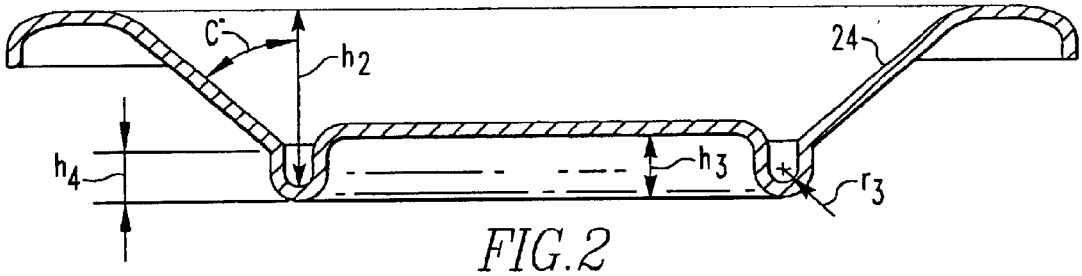
FIG.2 PRIOR ART
FIG. 2 (Prior Art) is a cross-sectional view through a metal end shell of the type illustrated and described in U.S. Pat. No. 6,065,634 (Brifcani et al.).
Figure 3:
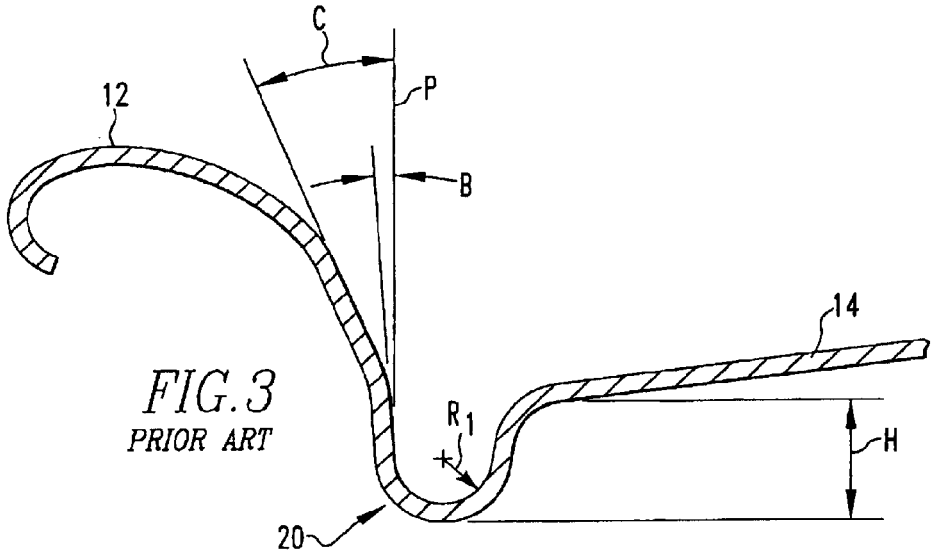
FIG.3 PRIOR ART
FIG. 3 (Prior Art) is a fragmentary cross-sectional view through a metal end shell of the type illustrated and described in U.S. Pat. Nos. 4,217,843 and 4,448,322 (Kraska).
Figure 4:
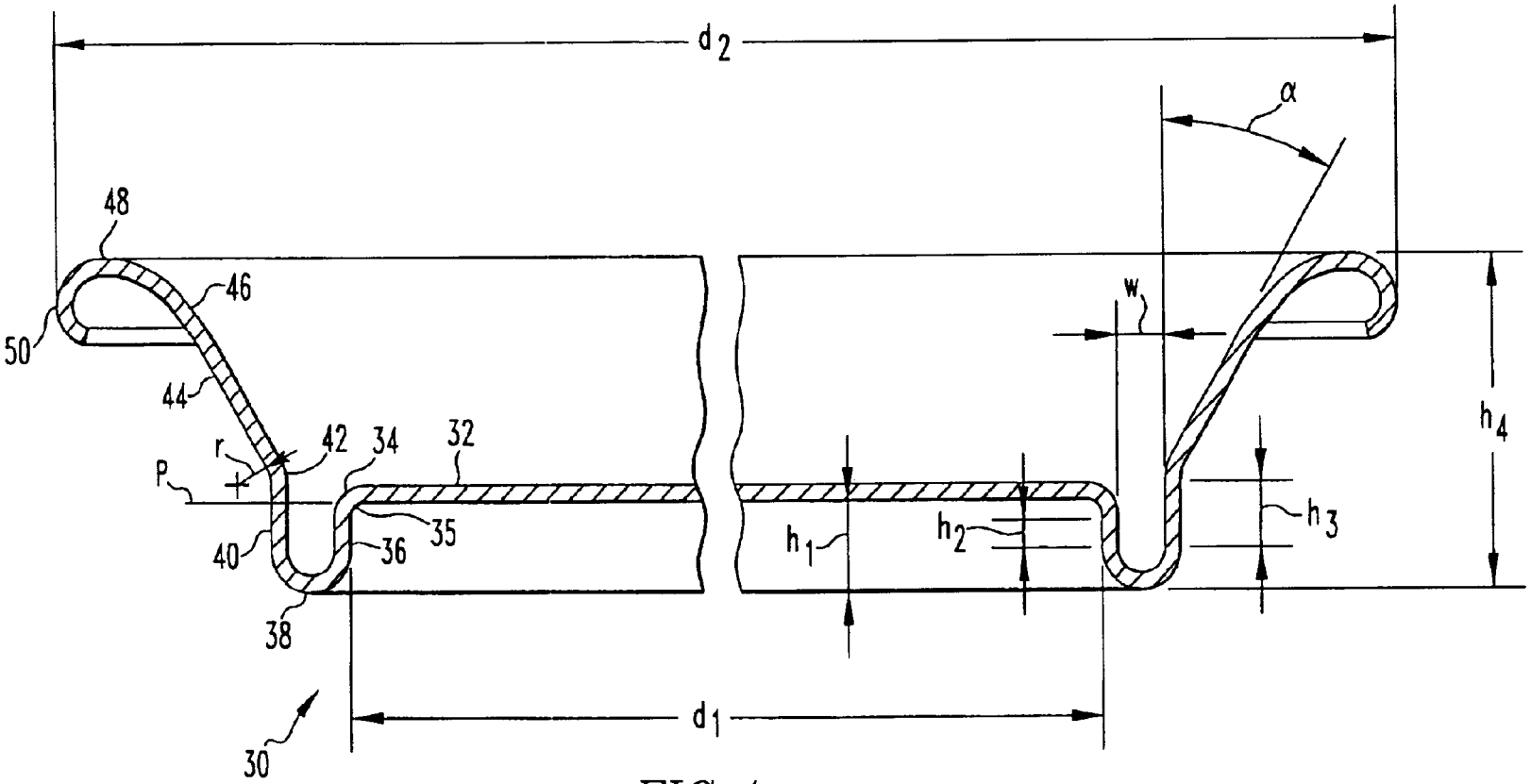
FIG. 4 is a cross-sectional view through a preferred embodiment of a metal end shell of the invention.

A preferred embodiment of a metal end shell 30 of this invention is illustrated in FIG. 4 as including a central panel 32, a panel radius 34 around the panel 32, a panel wall 36 extending downwardly from the panel radius, a countersink radius 38, a lower chuckwall portion 40 extending upwardly from the countersink radius 38, a chuckwall bend radius 42 at the top of the lower chuckwall portion 40, an upper chuckwall portion 44 extending upwardly and outwardly from the chuckwall bend radius 42, a seaming panel radius 46 at the top of the upper chuckwall portion, a seaming panel 48 extending outwardly from the seaming panel radius, and a curl 50 on the outer end of the seaming panel. The term "radius" as used above means the curved segment of sheet metal and not the radius of curvature, i.e., not the length of the straight line extending from the center of curvature. The radii of curvature are described below.

FIG. 4 shows a series of curved and generally straight portions of the end shell 30 (in cross-section). The extent of the curved portions, such as panel radius 34, countersink radius 38 and chuckwall bend 42, is generally to the point of tangency with the contiguous straight portion, such as central panel 32, panel wall 36, lower chuckwall portion 40 and upper chuckwall portion 44, or to the point of intersection between the contiguous curved segments of the seaming panel radius 46, seaming panel 48 and curl 50.

The extent of the straight (in cross-section) portions of the end shell 30 include $d_1$ as the diameter of the central panel 32 as measured between the points of tangency of the panel radius 34 with the panel wall 36 on product side of the end shell on both ends of a diametrical line through the center of the end shell. The curl diameter of the end shell is shown as $d_2$, and the panel depth $h_1$ is measured from the undersurface of the countersink radius 38 to the undersurface of the central panel 32 at its point of tangency with the panel radius 34. The height $h_2$ of the panel wall 36 is the vertical distance between the points of tangency of the panel wall 36 with the panel radius and the countersink radius. And $h_3$ is the vertical height of the lower chuckwall portion 40 as measured between the point of tangency of the countersink radius 38 with the lower chuckwall portion and the midpoint in the chuckwall bend 42. The overall depth $h_4$ (vertically) of the end shell is called the countersink depth and is measured from the top surface of the seaming panel to the upper or public surface of the countersink radius 38 at the bottom of the radius.

As used herein, the term "product side" means the undersurface of the end shell 30 since that is the side that faces the product when the end shell has been converted into an easy opening end and double seamed onto a filled can body. The product side may also be referred to as the undersurface or bottom surface. The "public side" is the top surface or upper surface of the end shell opposite the product side of the end shell.

This invention provides a unique and non-obvious profile for the end shell 30. This profile includes an upper chuckwall portion 44 having an angle $\alpha$ to vertical in the range of 20–35° and a countersink bead having a width w in the range of 0.020–0.040 inch as measured on the inside of the countersink groove (public surface) between the points of tangency of the countersink radius or radii with the panel wall 36 and the lower chuckwall portion 40. It is also a feature of this invention that it has a countersink depth $h_4$ that is less than about 0.250 inch and preferably less than about 0.243 inch depending on several factors such as the size of the end shell, the alloy, temper and thickness of the metal in the end shell, and the angle $\alpha$ of the upper chuckwall portion among other factors. The countersink depth $h_4$ may even be as low as 0.235 inch for some end shells.

The countersink depth $h_4$ in the preferred embodiments is generally independent of the diameter of the end shell. For example, end shells having 202 and 204 diameters preferably have about the same range of countersink depths with this invention.

Figure 5:
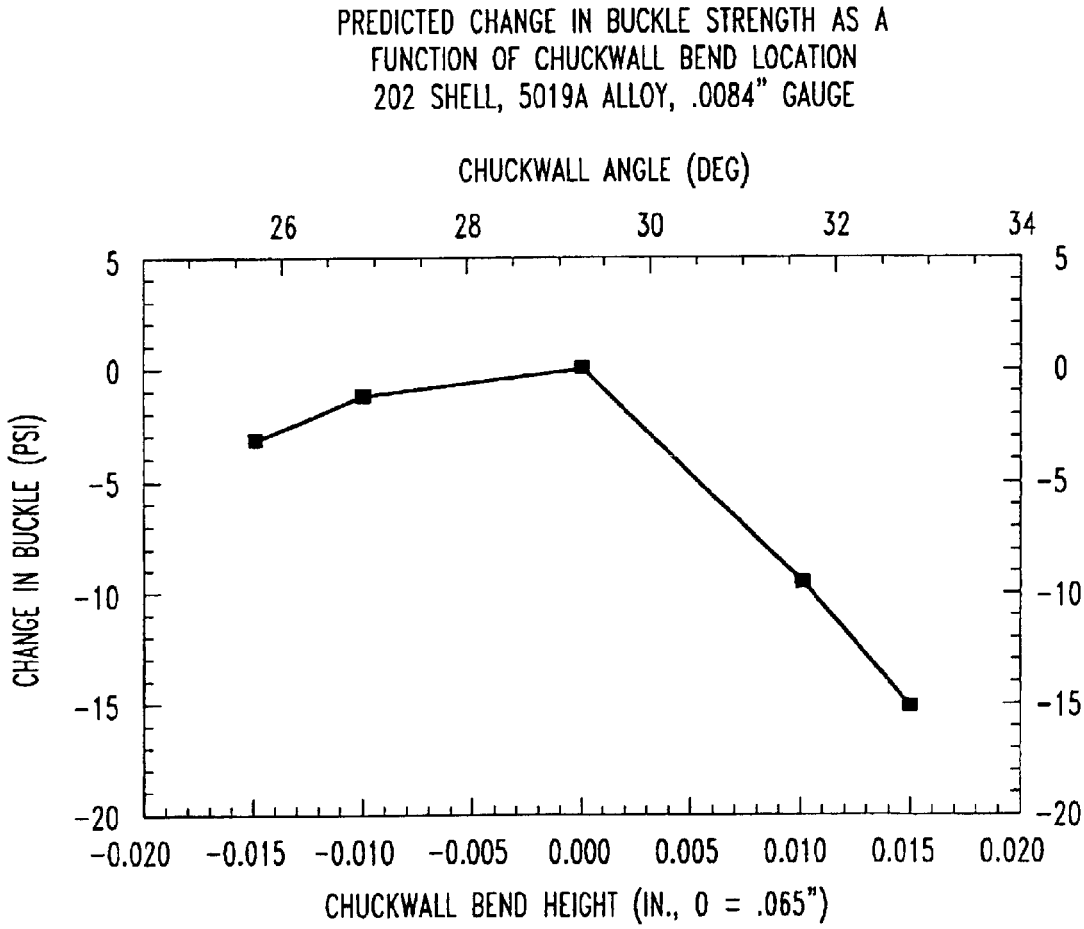
FIG. 5 is a graph showing changes in buckle resistance of end shells of this invention as a function of the angle of the upper chuckwall portion of the shells and the location of the chuckwall bend between the upper and lower chuckwall portions.

An end shell 30 of this invention preferably has a panel depth $h_1$ that is less than about 0.070 inch and preferably about 0.065 inch. The length $h_3$ of the lower chuckwall portion is influenced by the panel depth $h_1$ and the desired location of the chuckwall bend radius 42. The center of the radius of curvature r of the bend radius 42 is preferably within about 0.010 inch of a plane through the line of tangency of the central panel 32 with the panel radius 34. This location of such bend radius 42 is desirable for maintaining buckle resistance of the can ends formed from the end shell. FIG. 5 is a graph showing predicted changes in buckle resistance of end shells of this invention as a function of the location of the bend radius 42 and the angle of the upper chuckwall portion 44 to vertical. The data for this graph was generated by an analytical software program and partially confirmed by test data on end shells. If the other dimensions of the end shell remain constant, then raising or lowering the bend radius 42 also changes the angle of the upper chuckwall portion 44. The unique combination of the angle and the bend radius according to this invention is important in maintaining buckle resistance of the end shell.

Referring again to FIG. 4, the lower chuckwall portion 40 is preferably substantially vertical but may have a small angle to vertical. The panel wall 36 is also substantially vertical, but may have a small angle to vertical (see for example Biondich U.S. Pat. No. 4,991,735). The seaming panel 48 and the curl 50 are preferably conventional.

Figure 4A:
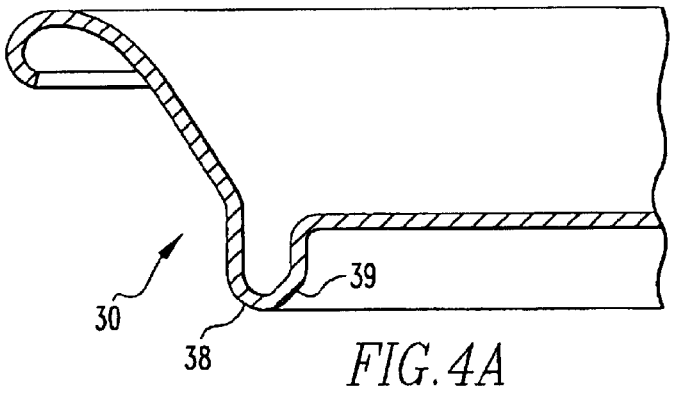
FIG. 4A is a fragmentary cross-sectional view of an alternative embodiment showing a compound curve of the countersink bead in the end wall.

The countersink radius 38 may be either a simple radius or a compound radius depending on several factors such as the tools used to form the end shell and/or reform it. A simple radius means a uniform or unchanging radius of curvature for the full extent of the countersink radius 38. A compound radius means that the radius of curvature changes along the length of the curved segment 38 as shown in FIG. 4A. The radius of curvature may be smaller or larger at different points along the length of the countersink radius. Generally speaking, the radius of curvature of the countersink radius 38 is preferably in a range of about 0.010 to 0.020 inch for a simple radius and about 0.006 to 0.040 inch for a compound radius of curvature.

End shells 30 of this invention are preferably formed from aluminum alloy sheet material having relatively high longitudinal yield strengths and/or longitudinal ultimate strength. Preferred alloys preferably have average longitudinal yield strengths of about 53.5 ksi and a minimum of about 52 ksi. They may have longitudinal ultimate strengths of more than about 59 ksi. As used herein, longitudinal yield strength and longitudinal ultimate strength are measured with the grain of the metal and parallel to the rolling direction. End shells of this invention are preferably formed from relatively thin gauge aluminum alloy sheet material having thicknesses of less than about 0.0088 inch or even less than about 0.0084 inch, but can be formed from thicker sheet metal. End shells of this invention may also be formed from steel sheet metal of various gauge thicknesses.

Figure 6:
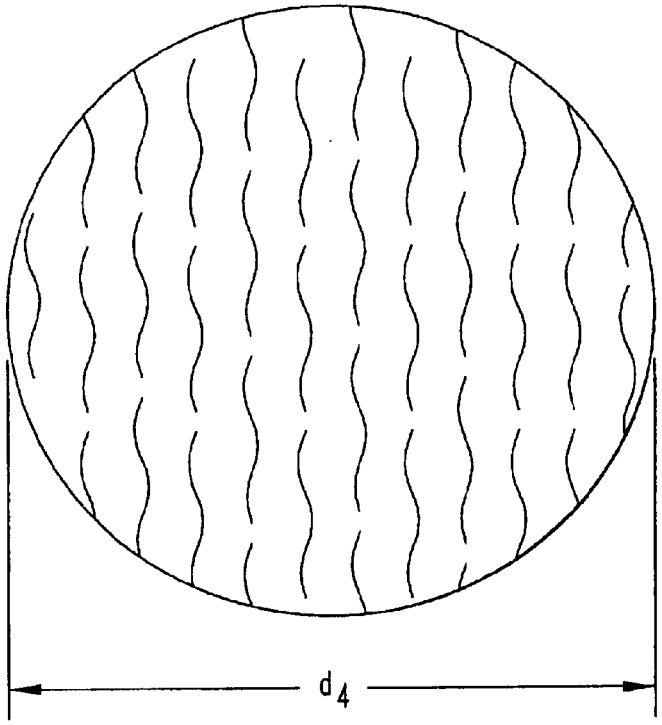
FIG. 6 is a plan view of a metal disc suitable for forming into a metal end shell of this invention.

FIG. 6 shows a metal disc of a type suitable for forming into an end shell of this invention, and includes an exaggerated representation of grains in the metal. The grains in the metal are produced by elongation of the metal during the rolling process used to form the sheet material. The grain runs generally parallel to the direction of rolling. Grain in the metal must be taken into consideration in the manufacture of end shells because the metal in the disc tends to elongate non-uniformly and "ear" or form a slightly irregular outer lip on the manufactured end shell. The discs used to manufacture end shells are therefore conventionally slightly out-of-round to accommodate for this earing. The cut edge diameter $d_4$ of the disc is conventionally measured transverse to the grain of the metal in the disc. It is believed that this invention may reduce the impact of earing on the final end shells and can ends that occurs in the manufacture of such end shells and can ends.

End shells 30 of this invention can be formed by a variety of methods and tools known in the art, with some modification of such tools. Representative of such methods and tools are those shown in U.S. Pat. Nos. 5,857,734 and 5,823,040 (Stodd), U.S. Pat. No. 4,109,599 (Schultz), and U.S. Pat. No. 4,808,052 (Bulso et al), the disclosures of which are incorporated herein by reference. As stated above, the methods and tools disclosed by these patents free form or partially free form the countersink radius in the end shells. The manufacture of end shells of this invention facilitate the use of a shallower draw using such methods and tools and may permit a shorted press stroke. This facilitates operation of the tools at faster speeds and lets the tools run more smoothly. It is believed that this invention will permit a shorter press stroke and may save energy in the operation of the presses.

End shells 30 of this invention are suitable to have performance enhancement reforming or coining performed on them. Several such techniques are known in the art as shown, for example, in U.S. Pat. No. 5,685,189 (Nguyen et al.), U.S. Pat. No. 5,149,238 (McEldowney et al.), and U.S. Pat. No. 4,991,735 (Biodich), among others. Such reforming or coining operations may be performed as separate operations or as part of the conversion of the end shells into easy opening can ends.

Figure 7:
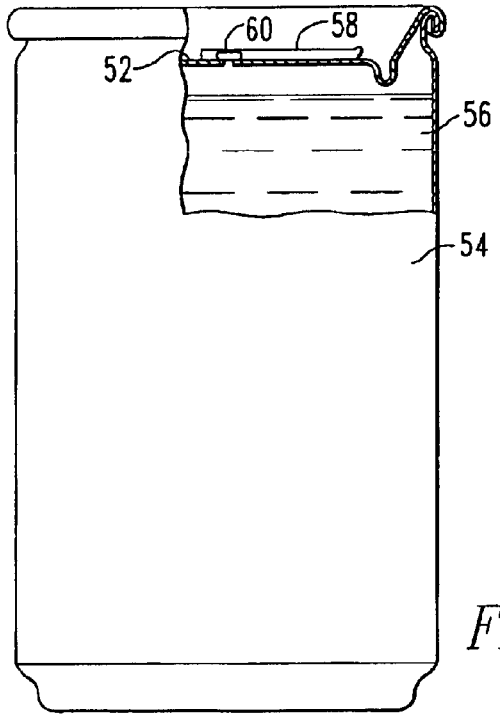
FIG. 7 is a fragmentary view, in partial cross-section, of an easy opening end of this invention double seamed on a metal can body.

FIG. 7 shows an easy opening can end 52 formed from an end shell of this invention on a can 54 filled with beer or beverage 56. The can end 52 has a pull tab 58 attached to a portion of the central panel of the end that is at least partially removable in order to form a pour opening in the can end. An integral rivet 60 is conventionally used to attach the pull tab 58 to the can end 52. The conversion of end shells into easy opening can ends is well known in the art. As stated above, such conversion processes may include reforming or coining of the end shell to enhance its resistance to buckling.

Figure 8:
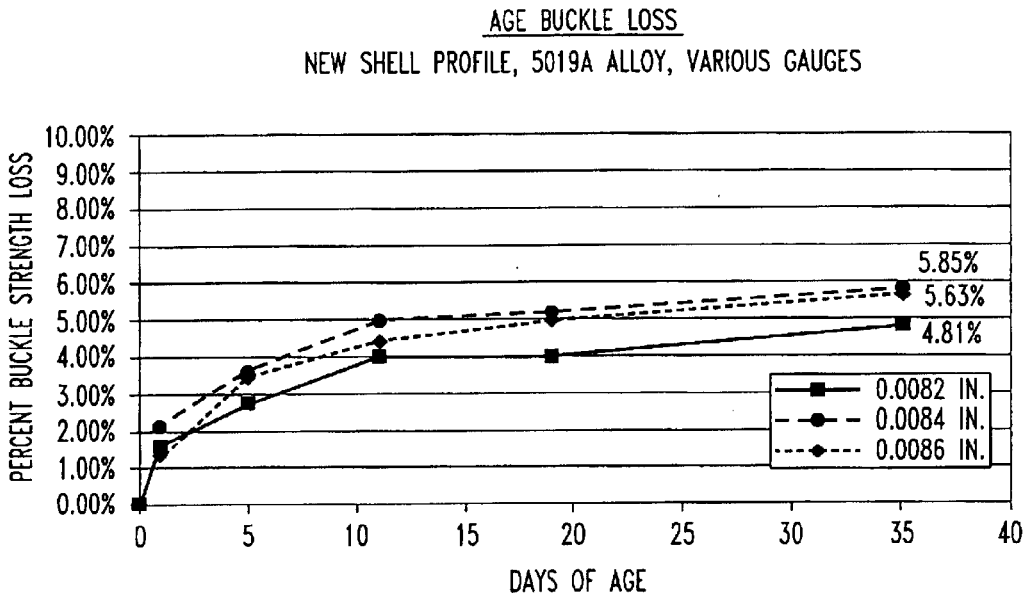
FIG. 8 is a graph showing age buckle resistance losses in end shells of this invention.

FIG. 8 is a graph showing age buckle losses in can ends made in accordance with this invention. The age buckle losses are typically measured over a period of 90 days, after which time there are minimal additional losses. As seen in this chart, 202 end shells of this invention made of H19 aluminum alloy have age buckle losses of less than 6% over a period of 35 days. The end shells have age buckle losses of less than about 8% and as low as about 6% over a period of 90 days. This is substantially less age buckle loss than in typical conventional prior art end shells, which have age buckle losses of approximately 8–9% at 30 days. Reduced age buckle losses with end shells of this invention will improve the manufacturer's ability to predict the eventual buckle resistance of his can ends when double seamed onto cans of pressurized beer or beverage.

The following table shows dimension of 202 end shells made in accordance with this invention in comparison with three typical commercially produced prior art end shells. The Prior Art 1 is typical of end shells made in accordance with U.S. Pat. No. 6,065,634 (Brifcani et al.); Prior Art 2 is typical of end shells made by tools sold by Redicon Corporation of Canton, Ohio; and Prior Art 3 is typical of end shells made by tools sold by Formatec Tooling Systems in Dayton, Ohio.

| Dimension (inch) | This Invention | Prior Art 1 | Prior Art 2 | Prior Art 3 |
|---|---|---|---|---|
| Cross Grain Cut Edge Diameter | 2.759 | 2.74 | 2.854 | 2.854 |
| Countersink | 0.235 | 0.255 | 0.270 | 0.270 |
| Panel Depth | 0.065 | 0.095 | 0.090 | 0.090 |
| Wall Transition | 0.065 | 0.060 | 0.060 | 0.060 |
| Countersink Radius | 0.015 | 0.020 | 0.020 | 0.020 |
| Panel Diameter | 1.847 | 1.690 | 1.855 | 1.851 |
| Cut Edge/Panel Diameter | 1.49 | 1.62 | 1.54 | 1.54 |
| Cut Edge/Countersink | 11.74 | 10.75 | 10.57 | 10.57 |
| Cut Edge/Panel Depth | 42.45 | 28.84 | 31.71 | 31.71 |
| Countersink/Panel Depth | 3.62 | 2.68 | 3.00 | 3.00 |

In accordance with this invention, the panel depth $h_1$ of the end shell is preferably less than about 0.070 inch and more preferably about 0.065 inch. The countersink depth $h_4$ is preferably less than about 0.250 inch and more preferably less than about 0.243 inch, and about 0.235 inch. A preferred end of this invention has a panel depth $h_1$ of about 0.065 inch and a countersink depth $h_4$ of about 0.235 inch. As previously described, end shells of this invention have an upper chuckwall portion 44 disposed at an angel of about 20–35 degrees to vertical, a countersink width of about 0.020–0.040 inch, and a chuckwall bend radius location within plus or minus about 0.010 inch of a plane P through the line of tangency 36 of the central panel portion 32 with the panel radius 34. These dimensions are preferred regardless of whether the end shell is 202 or 204, and possibly other shell diameters. The exact dimensions of the end shells will vary depending on a variety of factors such as metal alloy, temper and gauge, the particular tools used to form the end shells and the dimensions of such tools, and the preference of the particular manufacturer. The spring back of metal following completion of forming of the end shell at the bottom of the press stroke will also vary slightly, so the dimensions of the end shells will also vary accordingly.

Particular note should be taken of the substantially smaller panel depth $h_1$ and countersink depth $h_4$ of end shells of this invention while maintaining the panel diameter $d_1$ in order to provide a large enough central panel 32 in which to form easy opening features (tear strips and pull tab). The cut edge diameter of end shells of this invention is also close to the smallest cut edge diameter for the prior art, while providing a larger central panel diameter. End shells of this invention preferably have a ratio of the cut edge diameter to panel diameter of less than about 1.53, with a typical ratio of about 1.49. End shells of this invention also have a relatively high ratio of the countersink depth $h_4$ to the panel depth $h_1$, such as a preferred ratio of at least 3.50, and a typical ratio of about 3.62.

It is therefore seen that this invention provides end shells and converted easy opening ends that are well suited for manufacture from newer higher longitudinal yield strength metal. The end shells of this invention provide commercially acceptable buckle resistance with lower age buckle losses and facilitate metal savings. The invention reduces the draw required to form the end shells and improves performance of the forming tools. The unique combination of relationships in the end profile of this invention provides optimization of multiple parameters to minimize metal usage while maintaining acceptable commercial performance of the end shells.

Preferred embodiments of the invention have been described and shown for illustrative purposes. It will be apparent to those skilled in the art that many modifications can be made to the preferred embodiments without departing from the spirit of the invention or the scope of the appended claims.

What is claimed is:

1. An end shell for a container of contents under pressure comprising:

a substantially flat central panel portion;

a panel radius extending downwardly from the periphery of said central panel portion;

an annular countersink bead around said central panel portion including an annular panel wall extending downwardly from said panel radius around the periphery of said central panel portion, an upwardly open arcuate bottom wall having a width of about 0.020–0.040 inch as measured on the public surface of said end shell, and an upwardly projecting lower chuckwall portion;

an annular upper chuckwall extending upwardly and outwardly from said lower chuckwall portion with a chuckwall bend between said upper and lower chuckwall portions; and a peripheral curved flange projecting outwardly from the top of said upper chuckwall for double seaming the end shell on a container body;

wherein said lower chuckwall portion is substantially vertical, said upper chuckwall portion is disposed at an angle of about 20–35° to vertical, and a center of a radius of curvature of said chuckwall bend between said lower chuckwall portion and said upper chuckwall portion is within about 0.010 inch of a plane through the line of tangency of a straight portion of said central panel portion with said panel radius on the product side of said end shell, and said end shell has a countersink depth measured from the top of said peripheral curved flange to the upper surface of said arcuate bottom wall of said countersink bead at the bottom of the bead that is less than 0.250 inch.

2. An end shell as set forth in claim 1 in which said upper chuckwall portion is disposed at an angle of about 25–30° to vertical.

3. An end shell as set forth in claim 1 that has been converted into an easy opening end having a pull tab attached to a portion of said central panel portion that is at least partially removable therefrom.

4. An end shell as set forth in claim 1 which has a 202 diameter and which has been formed from a disc of an aluminum alloy having a cut edge diameter as measured transverse to the grain of the sheet before such forming that is not more than 153% greater than the diameter of said central panel portion in said end shell.

5. An end shell as set forth in claim 4 in which said cut edge diameter is not greater than 2.800 inches.

6. An end shell as set forth in claim 4 in which said cut edge diameter is not greater than 2.760 inches.

7. An end shell as set forth in claim 1 in which said upwardly open arcuate portion of said countersink bead has a radius of about 0.010 to 0.020 inch.

8. An end shell as set forth in claim 1 in which said upwardly open arcuate portion of said countersink bead has a compound radius of curvature.

9. An end shell as set forth in claim 1 which has a panel depth of less than 0.070 inch.

10. An end shell as set forth in claim 1 which has a panel depth of less than 0.065.

11. An end shell as set forth in claim 1 in which the end shell has a countersink depth measured from the top of said peripheral curved flange to the upper surface of said arcuate bottom wall of said countersink bead at the bottom of the bead that is less than 0.243 inch and a panel depth of about 0.057 inch.

12. An end shell as set forth in claim 1 which has a countersink depth of about 0.235 inch and a panel depth of about 0.065 inch.

13. An end shell as set forth in claim 1 which has a panel depth measured from the undersurface of said central panel portion to the bottom surface of said arcuate bottom wall that is less than 0.070 and a countersink depth of less than 0.250 inch.

14. An end shell as set forth in claim 1 which is made of aluminum alloy sheet material having an average longitudinal yield strength of about 53.5 ksi.

15. An end shell as set forth in claim 1 which is made of an aluminum alloy sheet material having a longitudinal ultimate strength of at least 59 ksi.

16. An end shell as set forth in claim 1 which has been formed from a disc of an aluminum alloy having a cut edge diameter as measured transverse to the grain of the sheet before such forming and in which said cut edge diameter was about 11 to 12 times the countersink depth of said end shell.

17. An end shell as set forth in claim 16 in which said cut edge diameter was about 11.5 times said countersink depth.

18. An end shell as set forth in claim 16 in which said cut edge diameter was about 42 to 55 times greater than the panel depth of said end shell.

19. An end shell as set forth in claim 1 in which said sheet material has a thickness less than 0.0088 inch before it is formed into the end shell.

20. An end shell as set forth in claim 1 in which said sheet material has a thickness less than 0.0084 inch before it is formed into the end shell.

21. An end shell as set forth in claim 1 which is made of aluminum alloy selected from a group comprising 5182 and 5019A alloys and which has age buckle losses of less than 6% thirty days after the end shell was formed and about 8% buckle loss after ninety days.

22. An end shell as set forth in claim 1 which has been converted into an easy opening end for a metal container body and includes a pull tab attached to a portion of said central panel that is at least partially removable therefrom.

23. An end shell as set forth in claim 4 in which said cut edge diameter was less than 2.760 inches, and said end shell has a center panel diameter of about 1.847 inches.

24. An end shell as set forth in claim 1 which is a 202 diameter end shell and has a ratio of countersink depth to panel depth greater than 300%.

25. An end shell having a 202 diameter for a container of contents under pressure comprising:

a substantially flat central panel portion;

a panel radius extending downwardly from the periphery of said central panel portion;

an annular countersink bead around said central panel portion including an annular panel wall extending downwardly from said panel radius around the periphery of said central panel portion, an upwardly open arcuate bottom wall having a width in a range of about 0.020–0.040 inch as measured on the public surface of said end shell, and a lower chuckwall portion projecting upwardly from an outer edge of said arcuate bottom wall;

an annular upper chuckwall extending upwardly and outwardly from said lower chuckwall portion, with a chuckwall bend between said upper and lower chuckwall portions; and a peripheral curved flange projecting outwardly from the top of said upper chuckwall for double seaming the end shell on a container body;

wherein said end shell has been formed from a disc of aluminum having a cut edge diameter less than 2.760 inches, said central panel portion has a diameter of about 1.847 inches said lower chuckwall portion is substantially vertical, said upper chuckwall portion is disposed at an angle of about 20–35 degrees to vertical, and a center of a radius of curvature of said chuckwall bend between said lower chuckwall portion and said upper chuckwall portion is within about 0.010 inch of a plane through the line of tangency of said central panel portion with said panel radius on the product side of said end shell, and said end shell has a countersink depth measured from the top of said peripheral curved flange to the upper surface of said arcuate bottom wall of said countersink bead at the bottom of the bead that is less than 0.250 inch.

26. An end shell as set forth in claim 25 which is made of aluminum alloy sheet material having an average longitudinal yield strength of about 53.5 ksi.

27. An end shell as set forth in claim 25 which has been formed from a disc of an aluminum alloy having a cut edge diameter as measured transverse to the grain of the sheet before such forming and in which said cut edge diameter was about 11 to 12 times the countersink depth of said end shell.

28. An end shell as set forth in claim 25 which has a panel depth of less than 0.070 inch.

29. An easy opening can end having a 202 diameter comprising:

a substantially flat central panel portion;

a pull tab attached to a portion of said central panel portion that is at least partially removable therefrom;

a panel radius extending downwardly from the periphery of said central panel portion;

an annular countersink bead around said central panel portion including an annular panel wall extending downwardly from said panel radius around the periphery of said central panel portion, an upwardly open arcuate bottom wall having a width of about 0.020–0.040 inch as measured on the public surface of said end shell, and an upwardly projecting lower chuckwall portion;

an annular upper chuckwall extending upwardly and outwardly from said lower chuckwall portion; and a peripheral curved flange projecting outwardly from the top of said upper chuckwall for double seaming the end shell on a container body;

wherein said easy opening can end has been formed from a disc of aluminum having a cut edge diameter less than 2.760 inches, said central panel has a diameter of about 1.847 inches, said lower chuckwall portion is substantially vertical, said upper chuckwall portion is disposed at an angle of about 20–35° to vertical, and a center of a radius of curvature of said chuckwall bend between said lower chuckwall portion and said upper chuckwall portion is within 0.010 inch of a plane through the line of tangency of a straight portion of said central panel portion with said panel radius on the product side of said end shell, and said end shell has a countersink depth measured from the top of said peripheral curved flange to the upper surface of said arcuate bottom wall of said countersink head as the bottom of the head that is less than 0.250 inch.

30. An easy opening can end as set forth in claim 29 having a panel depth less than 0.070 inch.

31. An easy opening can end as set forth in claim 29 made from aluminum alloy sheet material having an average longitudinal yield strength of about 53.5 ksi.

32. An easy opening can end as set forth in claim 31 that is made of an aluminum alloy selected from a group comprising 5182 and 5019A alloys and which has less than 6% age buckle loss thirty days after the end shell was formed and about 8% buckle loss after ninety days.

33. An easy opening can end as set forth in claim 29 which as a countersink depth that is less than 0.243 inch and a panel depth of about 0.057 inch.

34. An easy opening can end as set forth in claim 29 which as a countersink depth of about 0.235 inch and a panel depth of about 0.065 inch.

* * * * *